US005468080A

United States Patent [19]

Jones

[11] Patent Number: 5,468,080

[45] Date of Patent: Nov. 21, 1995

[54] POLY BAG PRINTER FOR PACKAGING MACHINE

[76] Inventor: William B. Jones, 4109 Creek Stone Ct., Stone Mountain, Ga. 30083

[21] Appl. No.: 36,967

[22] Filed: Mar. 25, 1993

[51] Int. Cl.[6] ..... B41J 15/16

[52] U.S. Cl. ..... 400/618; 347/215

[58] Field of Search ..... 400/120, 234, 400/703, 708, 711, 611, 613, 618; 346/1.1, 76 PH; 347/215, 217, 218, 219

[56] References Cited

U.S. PATENT DOCUMENTS

| | | | |
|---|---|---|---|
| 4,087,825 | 5/1978 | Chen et al. | 346/75 |
| 4,886,384 | 12/1989 | Harry | 400/120 |
| 4,909,648 | 3/1990 | Hartman et al. | 400/234 |
| 5,037,216 | 8/1991 | Nubson et al. | 400/120 |
| 5,080,512 | 1/1992 | Schofield et al. | 400/225 |
| 5,101,222 | 3/1992 | Hakkaku | 346/76 |
| 5,152,618 | 10/1992 | Goodwin et al. | 400/120 |
| 5,162,815 | 11/1992 | Hodge | 346/76 |
| 5,251,988 | 10/1993 | Frazier | 400/120 |

*Primary Examiner*—David A. Wiecking
*Attorney, Agent, or Firm*—Cort Flint; Henry S. Jaudon

[57] ABSTRACT

A printer is disclosed for printing on plastic film which comprises a pivotal printer carriage carried by a printer frame of the printer. The printer carriage includes a thermal transfer print head and at least one driven ribbon roll for drawing an ink ribbon across the print head. The print frame includes a plurality of directional rollers which direct the plastic film to a driven platen roller and to a downstream driven film roller. The drives of the film and ribbon rollers are synchronized so that the film and ribbon are advanced in a superposed relation across the print head. The printer carriage is pivoted to a printing position from a non printing position by a rotary actuator. In the printing position, the platen roller which consists of an neoprene roller having a durometer of 45, is spring biased against the print head with a controlled spring rate, and with the film and ribbon sandwiched therebetween. In this position, and with proper temperature control, the thermal print head transfers print onto the plastic in a reliable and clear manner. In particular, bar codes printed are of particularly sharp contrast and clear for accurate and reliable scanning. By positively engaging and advancing the film and ribbon together by means of the synchronized arrangement of the driven rollers positive advancement of even multiple layers of plastic sheeting may be had through the printer to print in a highly accurate manner. Sensors and a print controller are utilized to control the operation of the carriage actuator, synchronized drive, and print data, during the print cycle.

50 Claims, 8 Drawing Sheets

POLY BAG PRINTER FOR PACKAGING MACHINE

BACKGROUND OF THE INVENTION

The invention relates to the printing of a bar code and other matter on plastic film used to form a plastic or poly bag in which one or more articles is packaged.

Heretofore, plastic film as used in poly bags has been typically imprinted by using impact printers. However, the past printing techniques have not provided a highly accurate and reliable imprint of bar codes and the like printed matter on the plastic film. If the bar code is not accurately printed, then the bar code cannot be accurately read by a bar code scanner. In retail pricing use, personnel must be sent to manually determine the price, or the price is incorrectly input. Inaccurate bar code readings cause waste in time in manually discerning and inputting prices, and also result in inaccurate inventory control. Many of the problems associated with poor quality bar code printing and inaccurate bar code readings have to do with impact printing.

Various printer apparatus and method have been proposed for utilizing thermal printings on sheet material such as disclosed in U.S. Pat. Nos. 5,080,512; 5,101,222; and 5,162,815. However, these and other thermal printer apparatus and method have not provided an entirely suitable printing on plastic film.

Accordingly, an object of the present invention is to provide a printer for imprinting plastic film with bar code and the like printed matter in a simple yet reliable manner.

Another object of the invention is to provide a printer for imprinting plastic film used in the formation of poly bags for packaging articles.

Another object of the invention is to provide a printer for imprinting plastic film used in forming poly bags for packaging articles which can imprint the plastic film in the form of a single layer or in the form of a pre-formed bag having two or more layers.

Another object of the invention is to provide a printer for imprinting plastic film which is fed to a packing machine for the formation of poly bags for packaging articles in which the printer may be associated with the packaging machine such as an integral assembly at the infeed end of the packaging machine, or the printer may be used as a stand alone unit.

Another object of the present invention is to provide a printer for imprinting plastic film or other sheet material in a continuous manner at preselected panel areas of the film or other material.

SUMMARY OF THE INVENTION

The above objectives are accomplished according to the present invention by providing a printer for applying print to plastic film used in forming poly bags. The plastic film is supplied from a supply roll from which the plastic film is fed to the printer whereupon the plastic film is imprinted and delivered to a packaging machine for completion of the poly bag. The printer comprises a printer frame adapted to be mounted near the packaging machine. There is at least one infeed directional roll for guiding the plastic film. A printer carriage is movably carried by the print frame for reciprocating movement in a generally vertical direction. The print carriage has a first position in which the print carriage is moved to a retracted position to allow the plastic film to pass through the printer frame, and a second position in which the print head is moved to a printing position for transferring print onto the plastic film during a print cycle. A thermal transfer print head is carried by the carriage for applying print to a prescribed area of the plastic film. A driven platen roller is disposed above the print head when the print carriage is moved to the second position. The plastic film is frictionally held between the platen roller and the print head when the printer carriage is moved to the second position to grip and hold the plastic film in a print position. A ribbon feed roll contains a supply of ribbon carrying an ink media for transfer onto the plastic film. There is at least one driven ribbon roller for positively advancing the ribbon across the printer carriage in operative print transfer position relative to the print head. A synchronized drive assembly for driving the platen and ribbon rollers is provided to incrementally advance the plastic film and the ribbon in superposed relation across the print head at the same speed during the print cycle. The driven platen roller has an elastomeric outer covering, and is resiliently biased toward the print head when the carriage is in the second position. Springs are carried by the printer frame biasing opposing ends of the platen roller toward the print head, and include conical springs having a desired spring rate which facilities printing against the plastic film. The outer elastomeric covering of the platen roll has a durometer of about 45 durometers. A second, driven film roller is disposed downstream of the driven platen roll for engaging plastic film to positively advance plastic film in a printing relation to the print head together with the driven platen roller. The driven film roller forms a nip with the driven ribbon roller when the printer carriage is moved to the printing position, and the film and ribbon pass through the nip. There is also a driven ribbon take-up roll for taking up ribbon after passing the print head. The synchronized drive drives the driven ribbon roller and take-up roll in synchronization with driven platen roller to incrementally advance the film and ribbon. Outfeed directional rolls carried by the printer frame direct the plastic film from the driven film roller to an associated package forming machine. One of the outfeed rollers includes a movable directional roller which is adjustable in its vertical position. There is a second ribbon roller disposed below the drive ribbon roller through which the ribbon is passed in a generally serpentine configuration. The ribbon rollers also include an outer elastomeric surface for positively engaging and advancing the ribbon.

A dancer roll assembly is disposed between the plastic film supply roll and the infeed directional rollers of the printer for maintaining proper tension on the film as it is conveyed through the printer. The dancer roll assembly comprises a pair of pivotal arms between which a plurality of rolls are carried. The pivotal arms have a first position in which the supply roll is stationary, and a second position in which the supply roll is rotated to supply a predetermined length of the film.

An actuator is provided for moving the printer carriage between the first and second positions. A carriage sensor senses when the printer carriage is moved to a second position for generating a controller print signal. A register sensor senses the position of the prescribed area of the plastic film for actuating the print head in response to detecting the proper position of the print area to commence printing.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
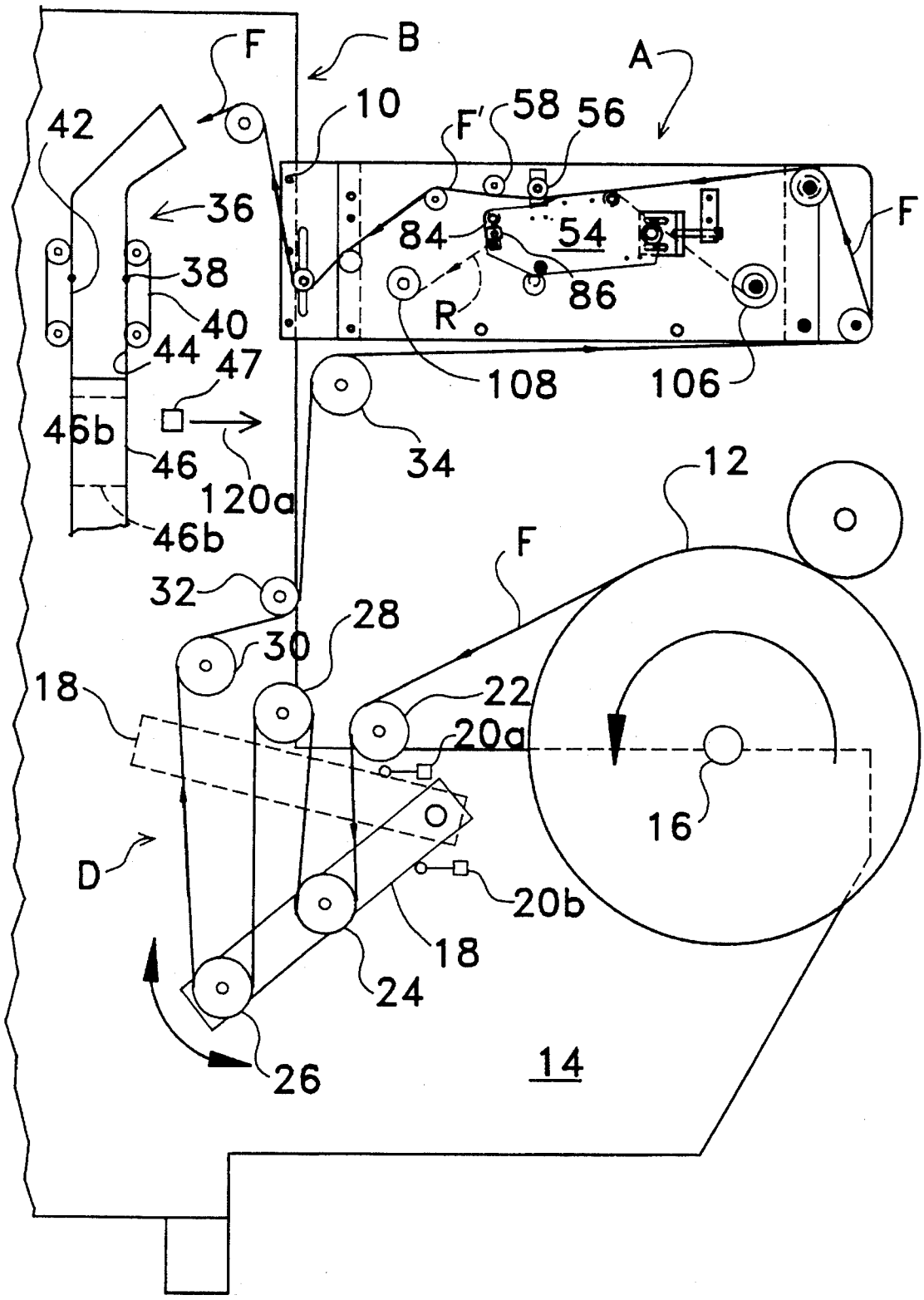
FIG. 1 is a side elevation illustrating a printer according to the invention as assembled with a packing machine.

Referring now in more detail to the drawings, a printer, designated generally as A is associated with a packaging machine B and may be made integral therewith by attachment using bolts 10. A supply roll 12 of plastic film is carried on an arm 14 by means of a journal 16. Plastic film F is drawn from the roll and passes through a dancer roller assembly, designated generally as D. The dancer roll assembly maintains proper tension on the plastic film and regulates advancement of the film from supply roll 12. The dancer roll assembly includes an arm 18 pivotally attached to frame arm 14. Pivotal arm 18 has a first position shown in full lines when supply roll 12 is not driven and a position as shown in the dotted lines in which supply roll 12 is driven to advance a certain length of film. Supply roll 12 is driven by a suitable DC drive motor (not shown). For purposes of detecting the position of pivotal arm 18, a pair of position switches 20*a*, 20*b* are provided. Switch 20*a* detects the dotted line position of arm 18 and turns the drive motor of the supply roll on and switch 20*b* detects the second position of the pivotal arm as shown in full lines and turns the drive motor of the supply roll off. Dancer roller assembly D further includes idler rollers 22, 24, 26, 28 and 30. Idler rollers 24, 26 are carried on pivotal arm 18. Directional rollers 32, 34 direct the plastic film to printer A. Plastic film F, after passing through-the printer, may be delivered to a forming section of packaging machine shown schematically at 36. The formation section of the packaging machine is where the plastic film is formed into a bag, and one or more articles are inserted in the bag. Such a formation section typically includes a clamping point 38 at which the plastic film is clamped while the bag is being formed and filled. Since such packaging machines are well known in the art, only so much of a conventional packaging machine as is necessary to an understanding of the invention will be illustrated. Accordingly, in the simplified, schematic example, driven belts 40, 42 may be utilized to convey the plastic film down across a form 44 which shapes the plastic film into a tube 46 that is heat sealed at 46*a* across the bottom. The bag is then filled with the article and severed and heat sealed across a portion 46*b* after being filled with one or more articles. The plastic film is clamped at clamping point 38 and extends to the printer, as will be more fully described below, while the package is being formed and/or filled. It is to be understood that the invention may be used to print on single layer plastic film which is fed to a packaging machine that both forms and fills the bag, or to print on multiple layer plastic film already formed into tubular stock that is only filled on the packaging machine and heat sealed on the ends.

Figure 2:
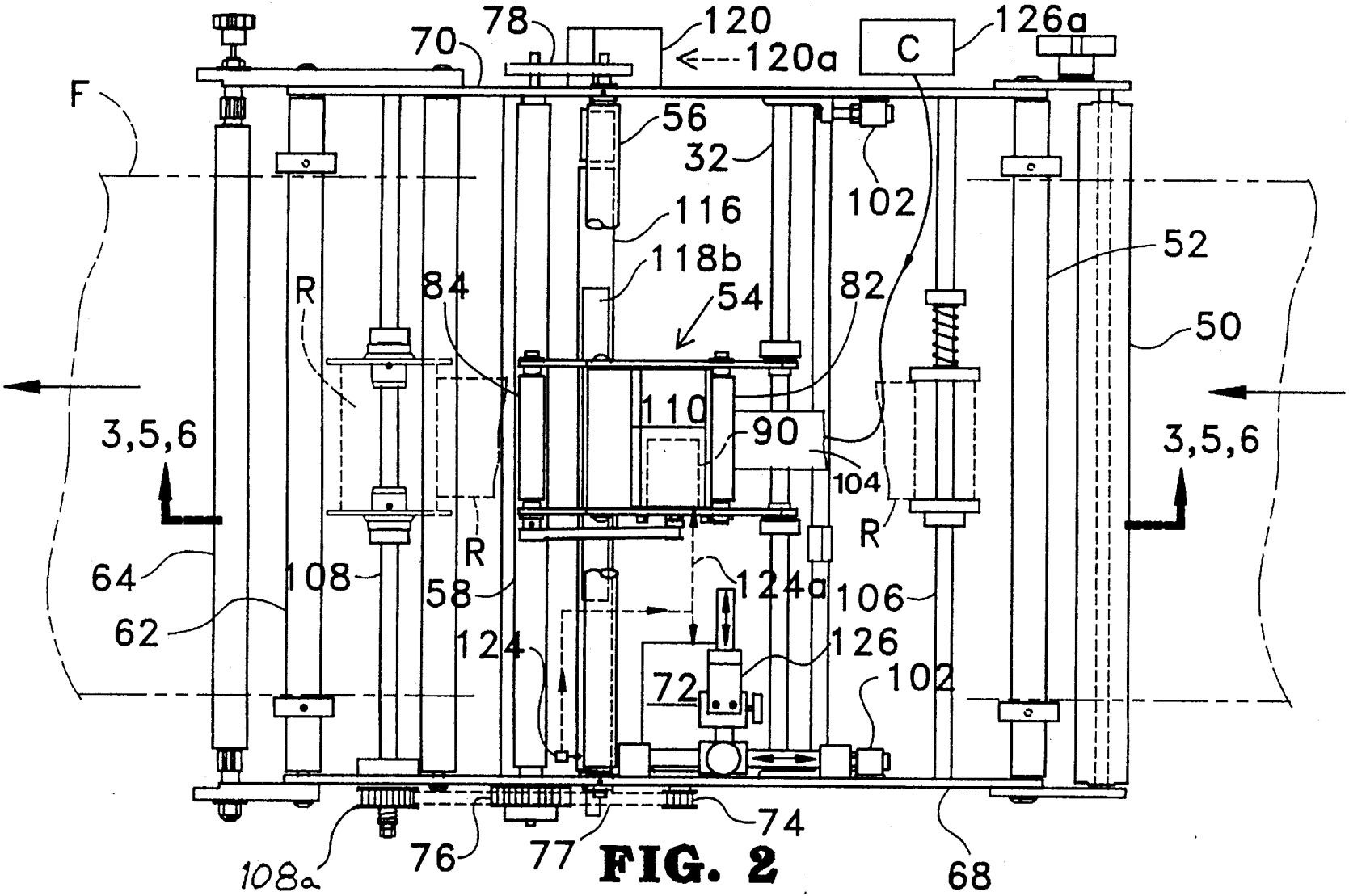
FIG. 2 is a top plan view of a printer constructed according to the invention.
Figure 3:
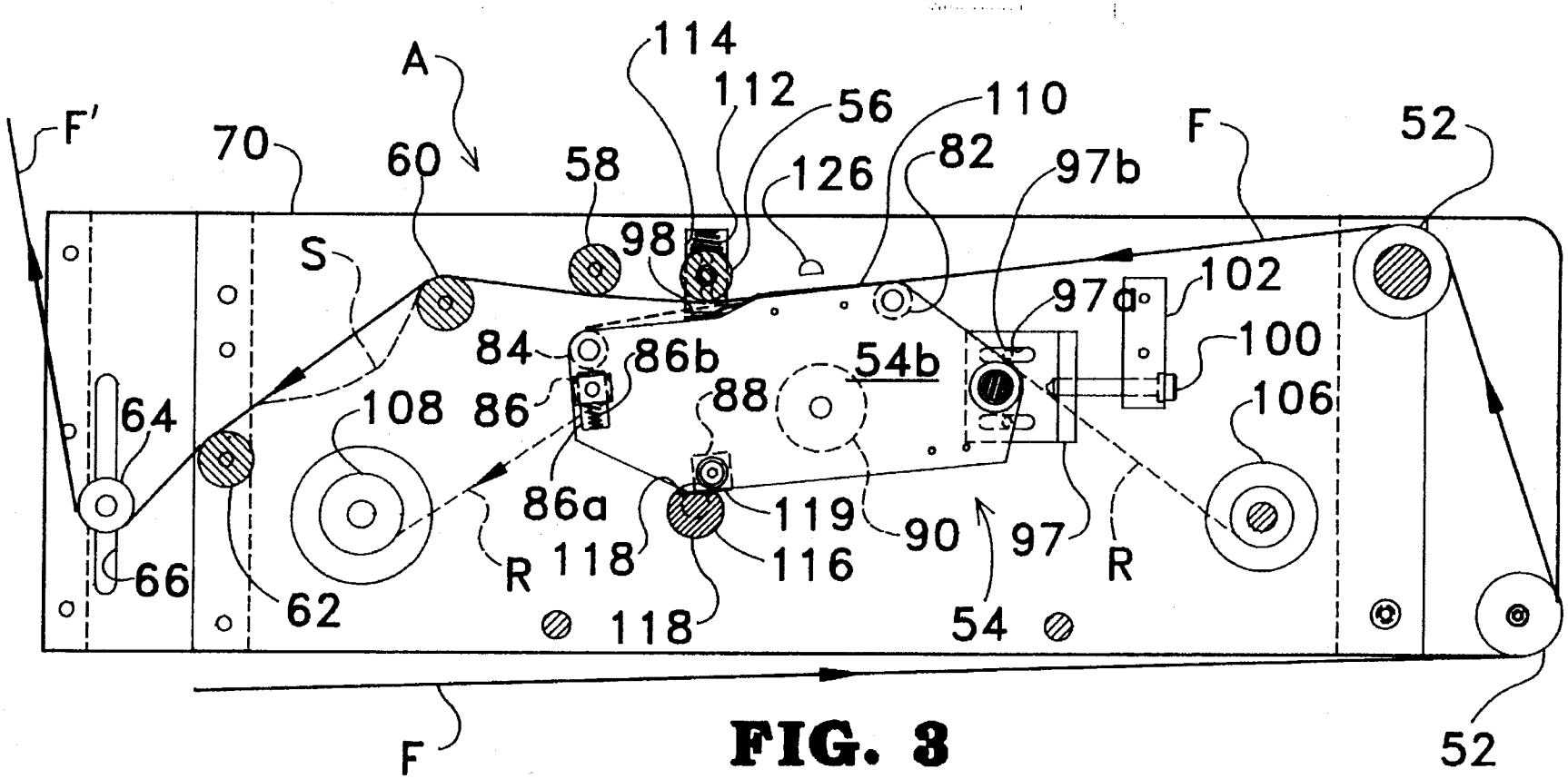
FIG. 3 is a sectional view taken along line 3—3 of FIG. 2.
Figure 3A:
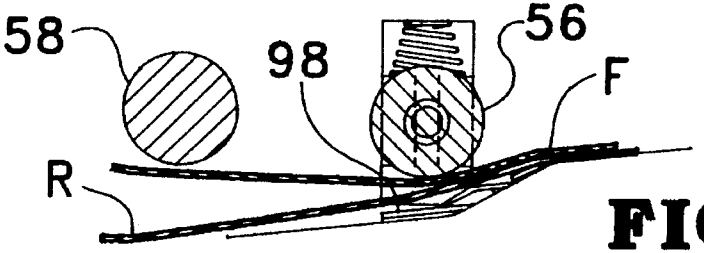
FIG. 3*a* is an enlarged sectional view of a printing position which includes a platen roller, plastic film, ribbon, and print head.
Figure 8:
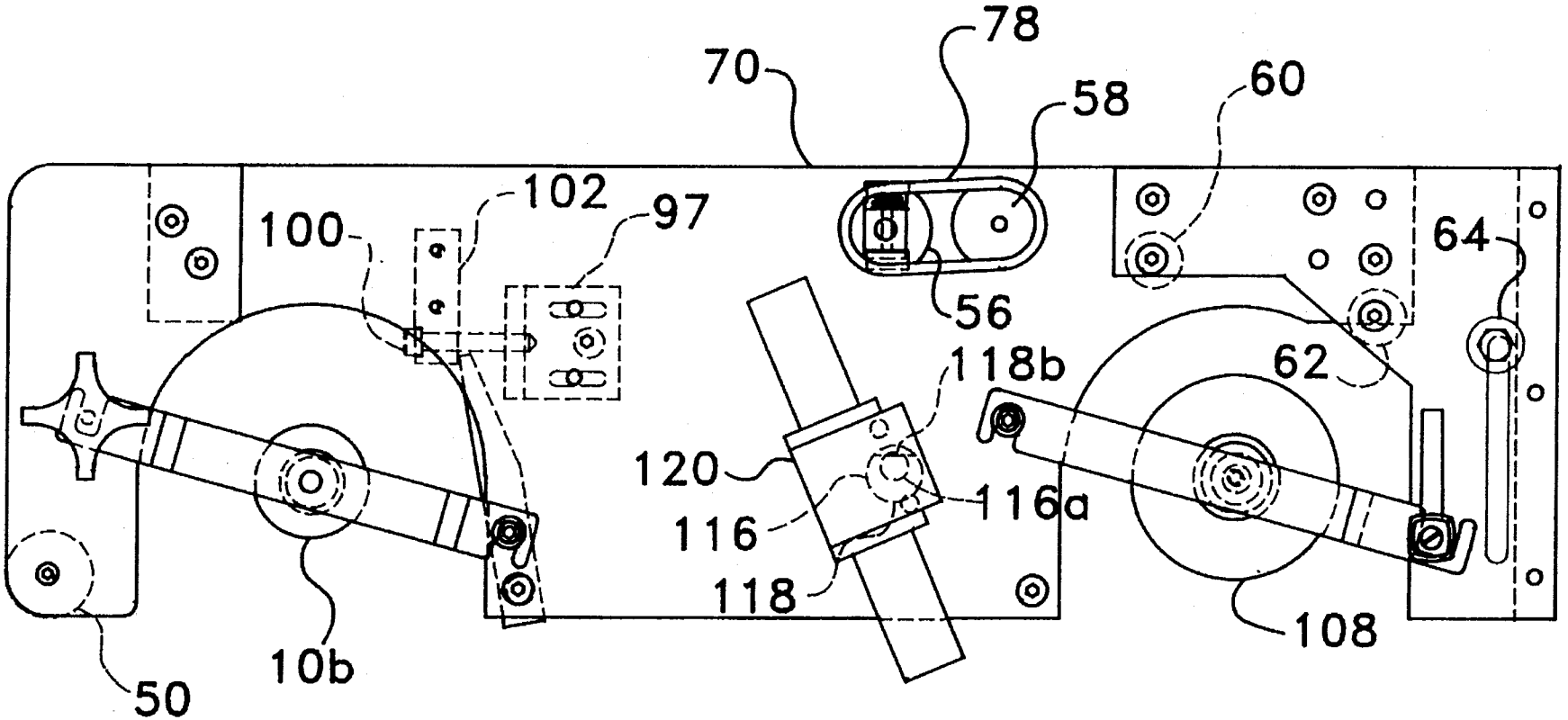
FIG. 8 is a side elevation of a printer according to the invention.

Referring now in more detail to printer A, as can best be seen in FIGS. 2 and 3, there is at least one infeed directional roller 50 which directs plastic film F coming from the dancer roll assembly to a second directional roller 52. The film next passes over a printer carriage, designated generally as 54, and underneath a pair of driven rollers 56, 58. There is a first driven, platen roller 56, and a second driven roller 58. Next, the plastic film travels over directional rollers 60, 62, 64. Directional roller 64 is carried in a slot 66 so that it may be adjusted in its vertical position to adjust tension on the film, for proper printing and conveyance. The rollers just described, are rotatably journaled by any suitable conventional means between a pair of side frames 68, 70 of the printer, as can best be seen in FIG. 2. Of the rollers just described, only rollers 56 and 58 are driven. For this purpose, there is a drive motor 72 in the form of a conventional stepping motor. Motor 72 is carried by side frame 68 and includes a drive shaft and drive pulley 74 extending therethrough. Drive pulley 74 of the stepping motor is connected to a toothed drive gear 76 attached to the shaft of driven roller 58 by a timing belt 77. The opposite end of driven roller 58 includes a sprocket 58*a* which connects a sprocket 56*a* on the shaft of driven roller 56 by means of a chain 78 (FIG. 8). In this manner, driven rollers 56, 58 are driven in synchronization by stepping motor 72.

Figure 4:
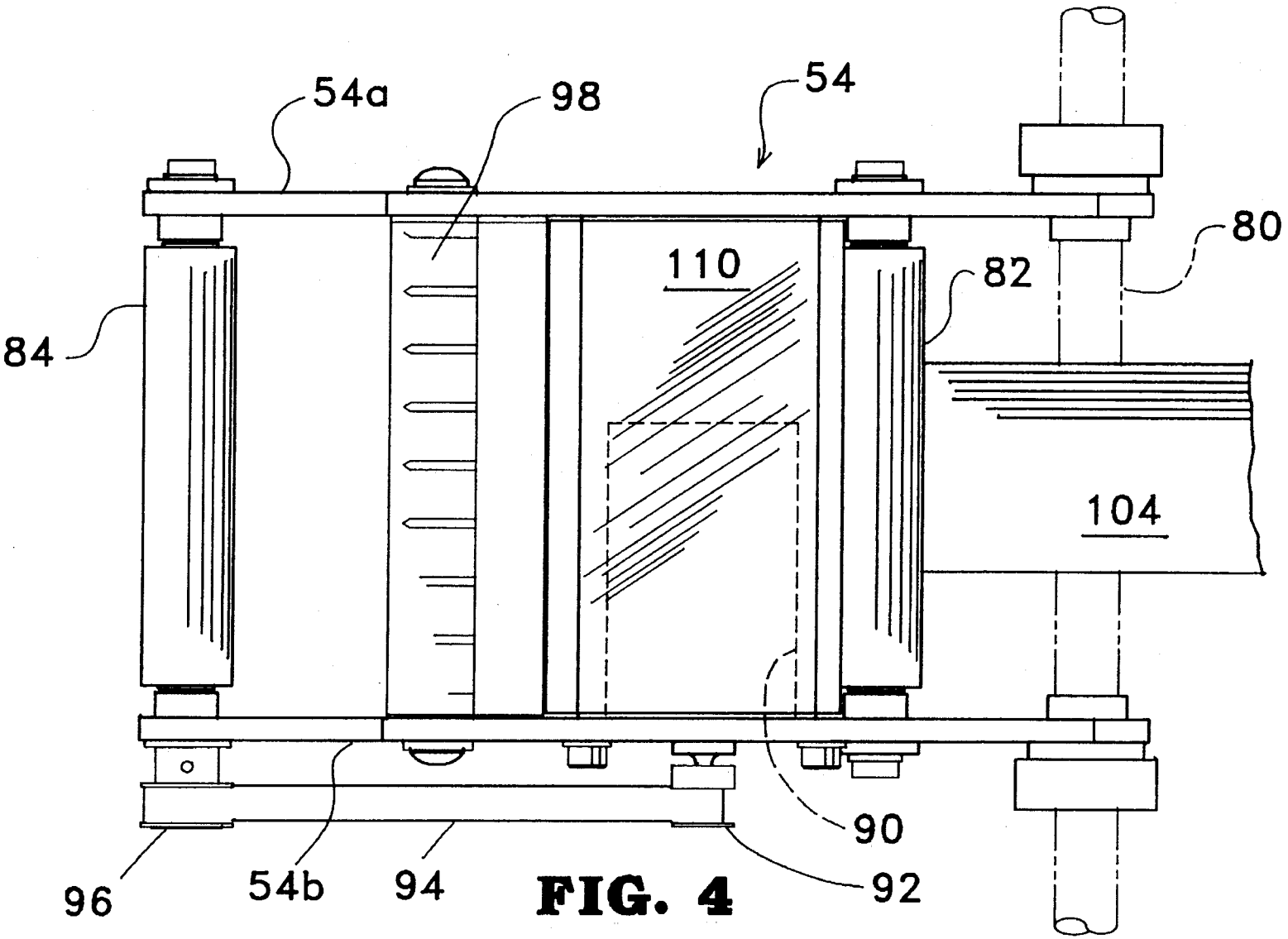
FIG. 4 is a top plan view of a printer carriage for a printer which imprints plastic film constructed according to the invention.

As can best be seen in FIGS. 3 through 6, printer carriage 54 is pivotally carried by a pivot shaft 80 extending through side plates 54*a*, 54*b* of the carriage, and between the side frames of the printer, as can best be seen in FIGS. 2 and 4. Also carried between side plates 54*a*, 54*b* is a directional roller 82 and a driven ribbon roller 84, and a roller 86. Ribbon roller 86 is carried in a vertical slot 86*a* so as to move up and down in the slot and is spring biased by means of a spring 86*b* in the slot. There is a bottom insert 88 attached between the side plates of the printer carriage with screws having a bearing surface 119. A second stepping motor 90 is carried by side plates 54*a*, 54*b*, and includes a drive shaft and drive pulley 92 extending through side plate 54*b*. A timing belt 94 drives driven roller 84, as can best be seen in FIG. 4. For this purpose, a second timing pulley 96 is carried on the end of shaft 84*a* of driven roller 84. Carried atop the printer carriage 54 is a print head 98 which may be any suitable heat transfer printer head such as a Model No. KF2003-BIS thermal print head manufactured by the Rohm Company of Tokyo, Japan. Printer carriage 54*a* may be adjusted in its longitudinal position relative to side frame 68, 70 of the printer by means of an adjustment bracket 97 which carries pivot shaft 80. Bracket 97 includes a pair of slots 97*a*, 97*b* by which the shaft is affixed to side plate 70 using suitable bolts. The opposite end of shaft 80 is affixed to side frame 68 in a similar manner. There is an adjustment bolt 100 carried by a journal housing 102. By means of threading the bolt in and out relative to housing 102, the longitudinal position of bracket 97 and hence printer carriage 54 and print head 98 may be determined. In this manner, printer carriage 54 may be adjusted so that print head 98 is positioned exactly beneath platen roller 56 in a proper print position. In this manner, accurate transfer of the print from the thermal print head to plastic film F may be had. Print head 98 is connected to a printer controller C by means of a conventional flat, electrical transmission cable 104. There is a ribbon supply roll 106 which is rotatably carried between side frames 68, 70 of the printer, and there is a ribbon take-up roll 108 also similarly carried between the side frame. A print ribbon R is supplied on supply roll 106 and taken up on take-up roll 108. Take-up roll 108 provides a second driven ribbon roller, and is driven by step motor 72 by way of timing belt 77 which meshes with a toothed pulley 108*a* affixed to the shaft of the take-up roll 108 by means of a conventional slip clutch. (FIG. 2). Ribbon R may be any suitable ribbon carrying an ink media for transfer onto plastic film F by means of thermal transfer of print head 98. Ribbon R goes from supply roll 106, directional roller 82, driven roller 84, driven roller 86, and take-up roll 108 as shown in dotted lines in FIG. 3. There is a ribbon slide plate 110 that the ribbon passes over to flatten and spread it out uniformly before passing over thermal print head 98 and beneath platen roller 56. Platen roller 56 is spring biased against plastic film F directly above, and radially contacting print head 98, by means of a conical spring 112, as can best be seen in FIGS. 3 through 6. Conical spring 112 is retained in a slot 114 as are the ends of the shaft of platen roller 56. Driven film rollers 56, 58 and driven ribbon rollers 84, 86 have an outer covering or surface of neoprene of a suitable durometer.

As printer carriage 54 is raised to a print position (FIG. 6), conical spring 112 applies a correct biasing pressure to the platen roller 56 and print head 98 which facilitates printing on plastic, along with appropriate temperature, as will be more fully explained later. To raise and lower printer carriage 54 to printing and non-printing positions, a cam shaft 116 is rotatably carried between side frames 68, 70. Cam shaft 116 includes a cam surface 118 and a flat surface 118*b*, as can best be seen in FIGS. 5 and 6. When the flat of camming shaft 116 is against a bearing surface 119 of the carriage assembly, the carriage assembly is in a first, non-printing position, as can best be seen in FIG. 5. When camming shaft 116 is rotated one hundred eighty degrees, camming surface 118 applies a force against bearing surface 119 to raise the printer carriage to a second, printing position, as can best be seen in FIG. 6. In the printing position, it can be seen that ribbon R and plastic film F are sandwiched between print head 98 and platen roller 56 with platen roller 98 radially contacting the plastic film against the print head at an area where it is desired for the print to be transferred. Drive shaft 116*a* of cam shaft 116 is driven and actuated by a rotary air cylinder 120 when a signal 120*b* is received from printer controller C when it is time to print another package. A suitable rotary air cylinder is model number RA101-180F-AB21-A manufactured by Schrader Bellows of Wadsworth, Ohio. When air cylinder 120 is actuated, rotary cam shaft 116 is rotated one hundred eighty degrees from the position shown in FIG. 5 into the printing position shown in FIG. 6 as will be explained more fully below. Cam shaft 116 rotates one hundred eighty degrees each time that cylinder 120 is actuated.

A registration sensor 126 is slidably carried on a guide rod 127 by a bushing 127*a* which support an adjusting housing 127*b* in which carries the sensor. Sensor 126 may be a suitable photoelectric cell and reciprocates with housing 127*b* for position adjustment. Sensor 126 detects registration marks 125 and generates signal 126*a*.

Operation

For purposes of illustrating one embodiment of the invention, an operation of an exemplary form of the invention will now be described. The description begins with the understanding that a printed bag has previously been filled and sealed at packing machine B, and it is time to being another print cycle.

Figure 9:
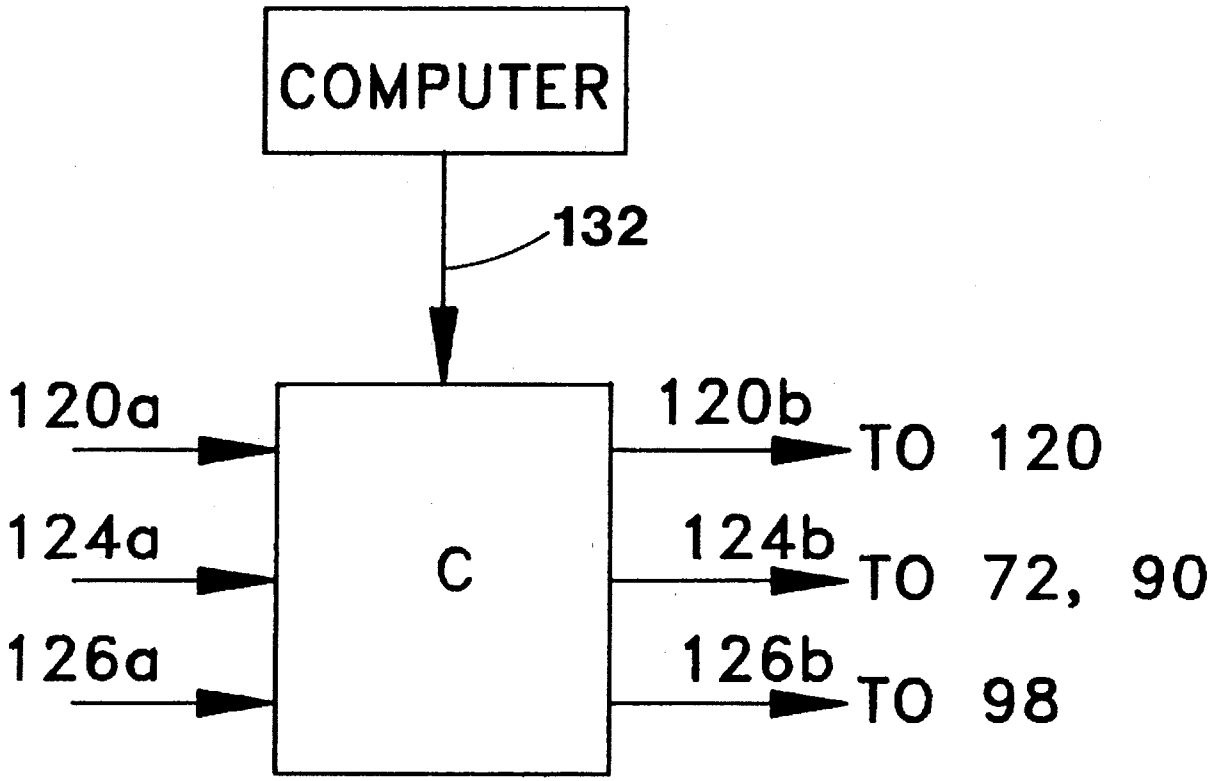
FIG. 9 is a schematic diagram of basic features of an exemplary control for a printer according to the invention.

Referring to FIG. 9, there are three sensors used to sense conditions and generate control signals for a print cycle of the printer. There is a first signal 120*a* which is delivered to print controller C indicates a time to print another bag and begin a print cycle. The print controller then sends a carriage control signal 120*b* to rotary actuator 120. Signal 120*a* may come from a sensor 47 at the packaging machine and be generated after a package is completed and it is time to feed another length of printed plastic film F' and print another window "W" of bag panel 128. Alternately, signal 120*a* may be a signal from another timing source when the printer is used as a stand alone unit. There is a second sensor 124 which senses movement of printer carriage 54 to the printing position for generating a second signal 124*a* that is delivered to printer controller C. Controller C then sends a motor control signal 124*b* to turn on step motors 72, 90 to incrementally advance the plastic film F and ribbon R. A third sensor 126 senses the presence of a registration mark 125 which indicates window "W" is in proper register with print head 98, and generates a third signal 126*a* which is sent to printer controller C. Controller C then sends a print signal 126*b* to activate print head 98 and fire the first line of print across window "W". The printer controller controls the step motors 72, 90 and print head 98 to incrementally advance film F and ribbon R and print in window W in steps until a completed window "W" is finished, including bar code 130. The printer controller then sends a motor control signal 124*b* turning off the step motors.

Figure 5:
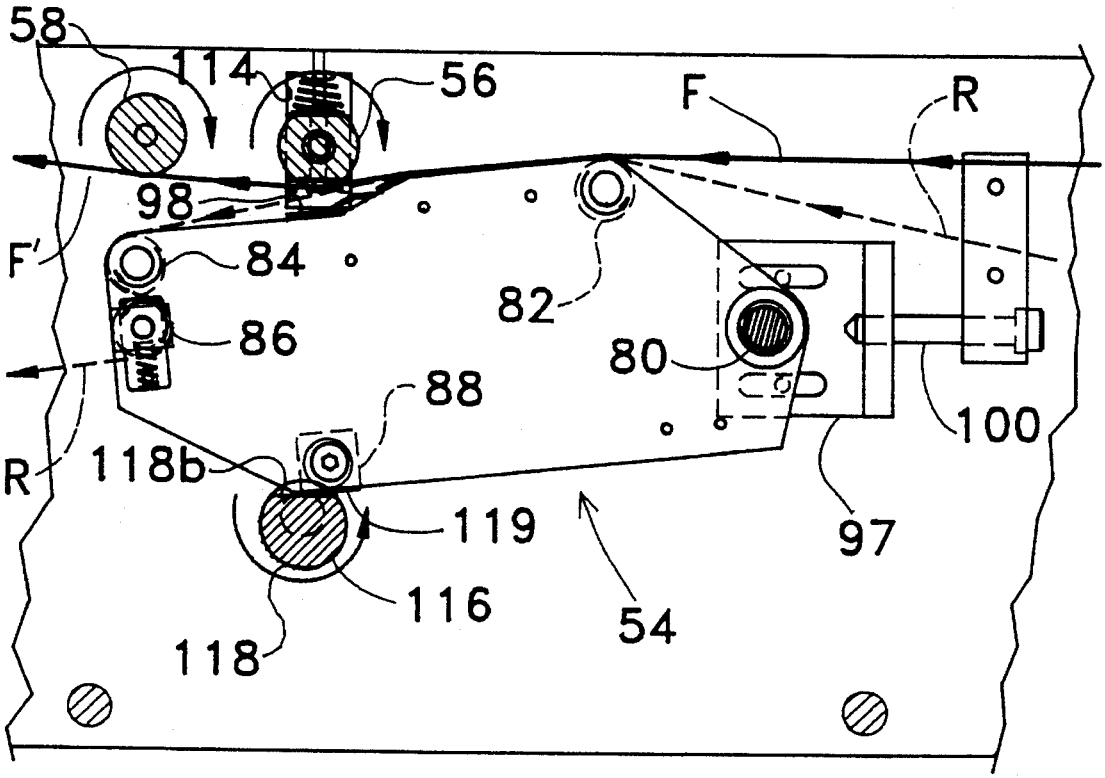
FIG. 5 is a side elevation illustrating a printer carriage of a printer according to the invention in a first, non-printing position.
Figure 6:
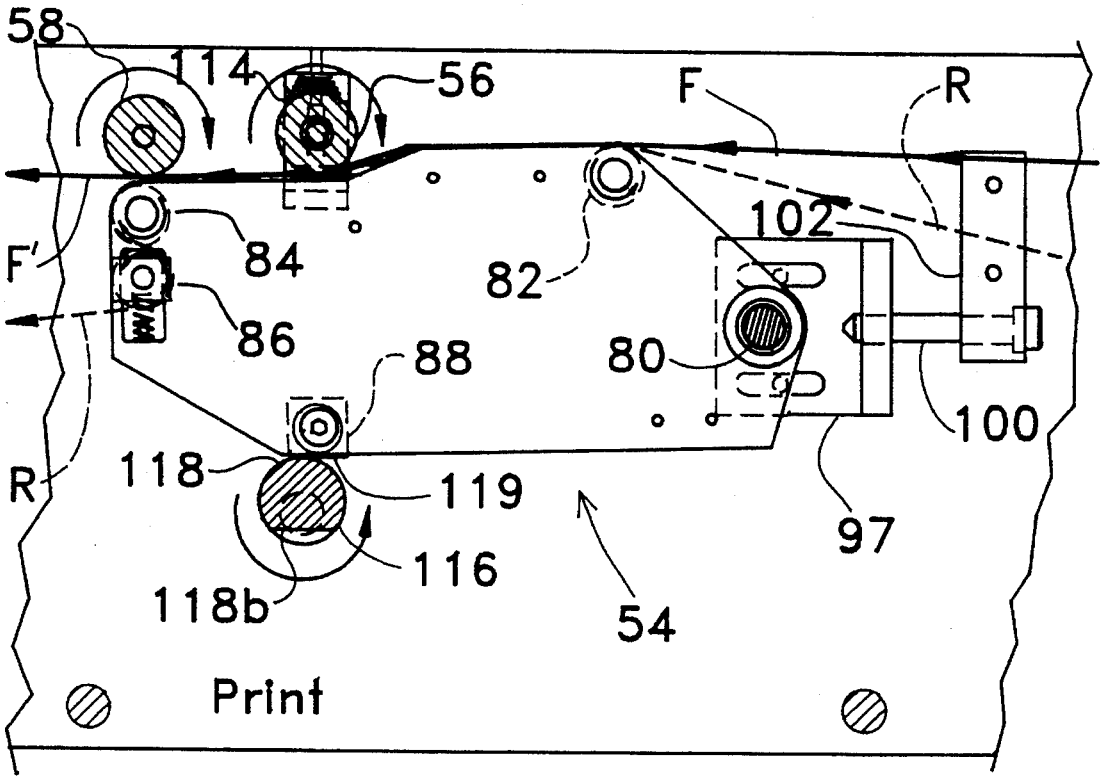
FIG. 6 is a side elevation illustrating a printer carriage of a printer according to the invention in a second, printing position.
Figure 7:
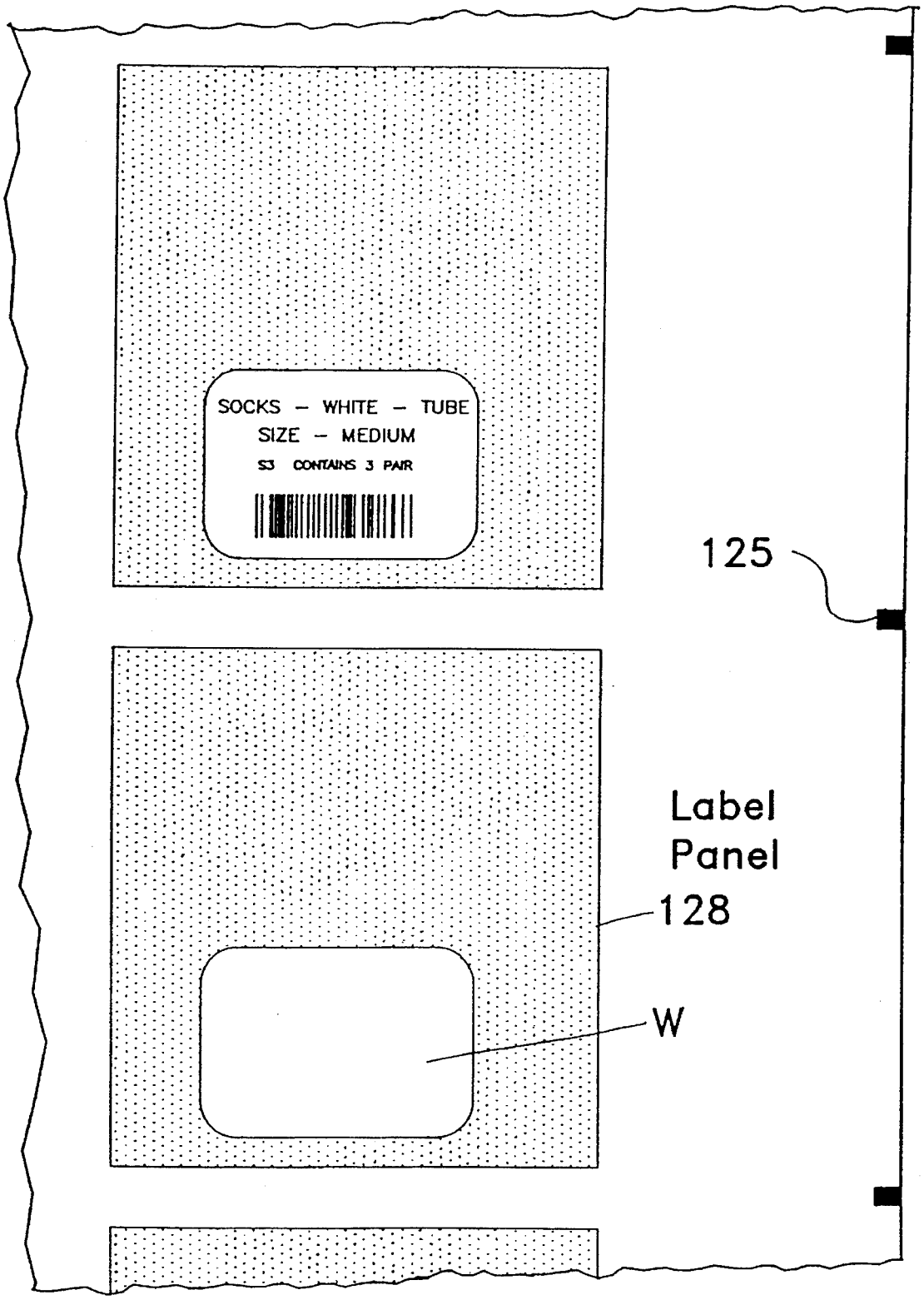
FIG. 7 is a plan view of plastic film having registration marks used to control a printer according to the invention for printing on the plastic film at selected panel areas along the length of plastic film as fed through the printer to an associated packaging machine.

When signal 120*a* is sent to air cylinder 120, air cylinder 120 is actuated by admission of air in a conventional manner, and shaft 116 is rotated 180 degrees. Shaft 116 is a cam shaft and has a cam 118 and flat 118*b* (FIG. 5). As cam shaft 116 rotates, bearing surface 119 comes off flat 118*b* and is engaged by cam 118 so that the print head is raised to the print position (FIG. 6). Switch 124 is tripped by a complete 180° rotation of shaft 116. Signal 124*b* is sent from the controller to turn on the step motors 72, 90 which drive ribbon roller and film rollers 56, 58, and ribbon roller 84, respectively. The step motors advance the film and ribbon in synchronization through the printer. At that time, film rollers 56 and 58 are driven by step motor 72 in the same direction, and at the same speed as ribbon roller 84 is are driven by step motor 90, so that the film and ribbon advance at the same speed. This drive arrangement facilitates either driving a single layer or multiple layers of plastic film, such as in a preformed bag. This is because the friction between driven platen roller 56 and print head 98 would normally cause relative sliding between two or more layers of plastic film in the print position. However, since the plastic film is positively driven by rollers 56 and 58 there is a positive drive of the plastic film through the print head no matter how many layers. Driven rollers 58 and 84 provide a nip (FIG. 6) between which film F and ribbon R are conveyed, except that ribbon R separates in a serpentine path around roller 86. Since the film is wider than the print ribbon relative sliding may often result causing one of the layers to bunch up. The driven rollers keep the film stretched tight between roller 56 and 58 to prevent this occurrence.

As the film is advanced through the printer, the registration mark 125 on the side of the film trips registration sensor 126. Registration signal 126*a* is sent to print controller C sends print signal 126*b* to fire the first line of print by print head 98. Print controller C now controls the printer and the bar code and other print designed to be printed on the window W of panel 128 is printed. The matter to be imprinted may be input to print controller C by way of a personal computer (FIG. 9). The computer is programmed with software to input the label print into the controller in a conventional manner. The speed of the step motors may also be input by way of the personal computer to control the advance speed of the film and the ribbon in correlation to the label matter to be printed. Print head 98 is a thermal print head so that the printing takes place by thermal transfer. The temperature at which the print head is operated in order to transfer the print on to the plastic film is normally programmed into the firmware of the print controller. Dip switches may be provided on the print controller to select a desired print temperature. The font may also be input by the personal computer into the print controller and the boldness of the print can be determined by temperature. This temperature may also be input 132 from the personal computer to the print controller. Printer controller C may be any suitable dedicated controller whose programming is well within the purview of an average artisan having been taught the operation of the present invention. For example, one source of a suitable controller is Cybertech of Horsham, Pa.

The ability to print on plastic is determined mainly by pressure. This pressure is controlled by conical springs 112 carried between roller 56 and the top of slot 114. The spring rate of the springs may be sized to provide the correct spring rate for the desired pressure and print. It has been found that a durometer of platen roller 56 must be equal to, or approximately, 45 durometers for plastic printing. During the print cycle, the film is not being taken up by the packaging machine B. This causes slack S to form in the film F (FIG. 3). Slack S is taken out when the print carriage drops down, the friction between driven platen roller 56 and print head 98, with the film held therebetween is released causing the slack in the film to be taken up by the dancer roll assembly shown in FIG. 1. A signal 120*b* is sent to rotary actuator 120 which rotates cam shaft 116 dropping the printer carriage to the retracted, non-printing position of FIG. 5, releasing the film. The printer is now ready for another length of plastic film to be drawn through the printer by roller belts 40 which feed packaging machine B.

The feed system for the film includes the supply roll of film 12 which is driven by a DC motor (not shown). This motor is controlled by the movement of dancer arm 18. When the dancer arm is on the dotted line position (FIG. 1), the DC motor turns on to pay off enough film until the dancer arm returns to the full line position. There is a sensor switch 20*a*, 20*b* on each position to control the drive of roll 12. The dancer assembly controls the proper tension on the film during the time the bag is being made as well as the time the bag is being printed.

It is also noted that while the printing is taking place, the previously printed bag is being filled and formed at 36. In the packaging machine, the sealing jaws hold the plastic film so that the plastic film does not move relative to the printer A or the bag assembly at this time. Clamping points 38 at of the packaging machine hold the film so that nothing taking place during the bag forming operation interferes with the plastic film operations previous to that. A typical packaging machine having such conventional features is manufactured by Europak, Inc. of Quebec, Canada. The present invention may be combined with such a machine. Printer A may also be used as a stand alone unit and print continuously or intermittently along a length of film at periodic areas. For example, printer A may print on already formed stock of continuous length tubular plastic film to be subsequently filled with product, and the feeding and receiving apparatus may be varied greatly.

While a preferred embodiment of the invention has been described using specific terms, such description is for illustrative purposes only, and it is to be understood that changes and variations may be made without departing from the spirit or scope of the following claims.

What is claimed is:

1. A printer apparatus for applying print to plastic film used in forming poly bags, said plastic film being supplied from a plastic film supply roll from which said plastic film is fed to said printer whereupon said plastic film is imprinted and delivered to a packaging machine for completion of said poly bag, said printer apparatus comprising:

a printer frame;

at least one infeed directional roll for guiding said plastic film;

a printer carriage movably carried by said print frame for reciprocating movement in a generally vertical direction, said print carriage having a first position in which said print carriage is moved to a retracted position to allow said plastic film to pass through said printer frame, and said print carriage having a second position in which said print head is moved to a printing position for transferring print onto said plastic film during a print cycle;

a print head carried by said carriage for applying print to a prescribed area of said plastic film;

a driven platen roller disposed adjacent to said print head when said print carriage is moved to said second position, said plastic film being frictionally held between said platen roller and said printer carriage when said printer carriage is moved to said second position to grip and hold said plastic film in a print position;

a roller nip disposed downstream of said driven platen roller through which said plastic film is positively advanced in a printing relation to said print head together with said driven platen roller during a print cycle, said roller nip including at least one driven film roller;

a ribbon feed roll containing a supply of ribbon carrying an ink media for transfer onto said plastic film;

at least one driven ribbon roller for positively advancing said ribbon across said printer carriage in operation print transfer position relative to said print head; and a synchronized drive assembly for driving said platen and ribbon rollers to incrementally advance said plastic film and said ribbon in superposed relation across said print head at the same speed during said print cycle.

2. The apparatus of claim 1 wherein print head is a thermal transfer print head.

3. The apparatus of claim 2 wherein said driven platen roll has an elastomeric outer covering.

4. The apparatus of claim 3 wherein said platen roller is resiliently biased toward said print head when said carriage is in said second position.

5. The apparatus of claim 4 including springs carried by said printer frame biasing opposing ends of said platen roller toward said print head.

6. The apparatus of claim 5 wherein said springs include conical springs having a desired spring rate which facilitates printing against said plastic film.

7. The apparatus of claim 4 wherein said outer elastomeric covering of said platen roller has a durometer of about 45 durometers.

8. The apparatus of claim 1 wherein said driven film roller forms said nip with said at least one driven ribbon roller when said printer carriage is moved to said printing position, and said film and ribbon pass through said nip.

9. The apparatus of claim 1 including a driven ribbon take-up roll for taking up said ribbon after passing said print head, said synchronized drive assembly driving said at least one driven ribbon roller and take-up roll in synchronization with said driven platen roller to incrementally advance said film and ribbon.

10. The apparatus of claim 1 including outfeed directional rollers carried by said printer frame for directing said plastic film from said at least one driven film roller to an associated package forming machine.

11. The apparatus of claim 10 including a plurality of said outfeed directional rollers one of which is a movable directional roller which is adjustable in its vertical position.

12. The apparatus of claim 1 including a ribbon roller disposed below said at least one driven ribbon roller through which said ribbon is passed in a generally serpentine configuration, said ribbon rollers being carried by said printer carriage for conveying said ribbon across said print head and to said ribbon take up roll.

13. The apparatus of claim 12 wherein said ribbon rollers include an outer elastomeric surface for positively engaging and conveying said ribbon.

14. The apparatus of claim 1 comprising a dancer roll assembly disposed between a plastic film supply roll and said infeed directional rollers of said printer for maintaining proper tension on said film as it is conveyed through said printer.

15. The apparatus of claim 14 wherein said dancer roll assembly comprises a pair of pivotal arms between which a plurality of rolls are carried which receive said plastic film from said supply roll, said pivotal arms having a first position in which said supply roll is stationary, and a second position in which said supply roll is rotated to supply a predetermined length of said film.

16. The apparatus of claim 15 comprising supply sensors for sensing the position of said pivotal arms in said first and second positions.

17. The apparatus of claim 1 including a carriage drive for moving said printer carriage between said first and second positions, and a carriage sensor for sensing when said printer carriage is moved to said second position for generating a controller print signal.

18. The apparatus of claim 1 comprising a register sensor for sensing the position of said prescribed area of said plastic film for actuating said print head in response to detecting said proper position of said print area to commence printing.

19. The apparatus of claim 1 including a plurality of outfeed directional rolls which direct said film from said platen roll in a generally horizontal run, a generally downward run, and then a generally upward run.

20. The apparatus of claim 19 wherein a slack is created in said film in said downward run of said film during said print cycle.

21. The apparatus of claim 20 wherein said dancer roll assembly takes said slack out of said film when said printer carriage is released from said second position after said print cycle.

22. In combination, a packaging machine for filling and forming a poly bag and a printer for imprinting print on plastic film from which said poly bag is formed, said packaging machine having a clamping point at which said plastic film is clamped in an operational position, said combination comprising:

a supply roll of plastic film carried near said machine frame;

a printer carried by said machine frame which includes a printer frame to which said plastic film is fed;

a movable printer carriage carried by said printer frame having a first position in which said print head is retracted from said plastic film, and a second position in which said print head is disposed in an operational printing position for imprinting on a prescribed area of said plastic film;

a thermal transfer print head carried by said printer carriage for transferring print to said plastic film in said printing position;

an actuator for moving said printer carriage between said first and second positions;

a driven platen roller carried by said printer frame for conveying said plastic film to said printing position, said platen roller including an outer elastomeric surface of a prescribed durometer and being biased towards said print head in said printing position with said plastic film being sandwiched between said print head and said platen roller;

a roller nip disposed downstream of said driven platen roller through which said plastic film is positively advanced in a printing relation to said print head together with said driven platen roller, said roller nip including at least one driven film roller;

a ribbon supply carried by said printer frame having an ink media for being transferred onto said plastic film;

at least one driven ribbon roller for advancing said ribbon over said print head in a configuration wherein said ribbon is sandwiched between said plastic film and said print head, transfer of said ink in the form of said print upon said prescribed area of said film;

a synchronized drive assembly for driving said platen roller and ribbon roller in synchronization so that said film and ribbon are conveyed across said print head in synchronization; and a sensor for detecting the proper position of said prescribed area of said film in relation to said print head for activating said print head to transfer said print to said prescribed area.

23. The combination of claim 22 comprising a first sensor for generating a first signal indicating a time to commence a print cycle;

said actuator being actuated in response to said first signal to move said printer carriage to said second position, and a carriage position sensor for detecting when said print head is in said printing position for generating a second signal to initiate said synchronized drive assembly;

a registration sensor sensing the presence of said prescribed area of said film in said printing position over said print head and generating a third signal; and said print head being operated in response to said third signal to commence transfer of print upon said plastic film during said print cycle.

24. The combination of claim 23 comprising a controller for processing said first signal, second signal, and third signal, for controlling said actuator, synchronized drive assembly, and printer.

25. The combination of claim 22 wherein said driven film roller forms said nip with said driven ribbon roller for advancing said film ribbon across said print head during operation of said print head so that said print is imprinted on said prescribed area during said print cycle in a reliable manner.

26. The combination of claim 22 wherein slack film is created in said plastic film between said packaging machine and said platen roller during said print cycle.

27. The combination of claim 26 comprising a dancer roll assembly disposed between said supply roll of plastic film and said platen roller which takes up said slack of said plastic film when said printer carriage is moved to said first position following said print cycle.

28. A printer apparatus for applying print to plastic film used in forming poly bags, said plastic film being supplied from a supply roll from which said plastic film is fed to said printer whereupon said plastic film is imprinted, said printer apparatus comprising:

a printer frame;

at least one infeed directional roll for guiding said plastic film to an entrance of said printer frame;

a printer carriage movably carried by said print frame for reciprocating movement in a generally vertical direction, said print carriage having a first position in which said print carriage is moved to a retracted position to allow said plastic film to pass over said print carriage, and said print carriage having a second position in which said print head is moved to a printing position for transferring print onto said plastic film during the print cycle;

a thermal print head carried by said carriage for applying print to a prescribed area of said plastic film during said print cycle;

an actuator for moving said printer carriage between said first and second positions;

a driven platen roller disposed adjacent said print head when said print carriage is moved to said second position, said plastic film being frictionally held between said platen roller and said print head when said printer carriage is moved to said second position to grip and hold said plastic film in said printing position during said print cycle;

a roller nip disposed downstream of said driven platen roller through which said plastic film is positively advanced in a printing relation to said print head together with said driven platen roller, said roller nip including at least one driven film roller;

a ribbon feed roll which Includes a supply of ribbon for transferring ink onto said plastic film, said ribbon feed roll being carried by said printer frame;

at least one driven ribbon roller for positively advancing said ribbon across said printer carriage in operation print transfer position relative to said print head and film; and a synchronized drive assembly for driving said driven platen roller, driven film roller, and driven ribbon roller to advance said plastic film and said ribbon in superposed relation across said print head at the same speed.

29. The apparatus of claim 28 comprising a film sensor for sensing the position of said prescribed area of said plastic film for actuating said print head in response to detecting said proper position of said print area.

30. The apparatus of claim 28 wherein said driven platen roller has an elastomeric outer covering.

31. The apparatus of claim 30 wherein said platen roller is resiliently biased toward said print head when said carriage is in said second position.

32. The apparatus of claim 31 wherein conical springs biasing said platen roller against said print head having a desired spring rate which facilities printing against said plastic film.

33. The apparatus of claim 30 wherein said outer elastomeric covering of said platen roller has a durometer of 45 durometer.

34. The apparatus of claim 28 wherein said driven film roller disposed downstream of said driven platen roller has a friction surface, and said driven film roller and said at least one drive ribbon roller define said nip to positively advance said plastic film and ribbon in a printing relation when said printer carriage is in said second position.

35. The apparatus of claim 34 including a driven ribbon take up roll carried by said printer frame for taking up said ribbon after passing across said print head.

36. The apparatus of claim 35 including a ribbon roller disposed below said driven ribbon roller defining a nip therebetween which said ribbon is passed in a generally serpentine configuration.

37. The apparatus of claim 36 wherein said first and second driven ribbon rollers include an outer elastomeric surface for positively engaging and conveying said ribbon.

38. The apparatus of claim 36 including outfeed directional rolls carried by said printer frame for directing said plastic film from said driven film roller from an exit of said printer frame; and one of said directional rollers is a movable directional roll which is adjustable in its vertical position.

39. The apparatus of claim 28 including a carriage position sensor for sensing when said printer carriage is moved to said second position for generating a ready print signal.

40. The apparatus of claim 28 comprising a first sensor for generating a first signal indicating the commencement of a print cycle;

said actuator being actuated in response to said first signal to move said print carriage to said second position;

a second sensor for sensing movement of said printer carriage to said second position for generating a second signal for actuating said synchronized drive assembly; and a third sensor sensing the presence of said prescribed area of said film in a printing position over said print head and generating a third signal to activate said print head to transfer print upon said plastic film.

41. The apparatus of claim 40 comprising a controller for processing said first signal, second signal, and third signal, and for controlling said print head including the operational temperature of said print head.

42. The apparatus of claim 41 comprising a computer having an operator input for inputting temperature data, and an output for controlling said print controller.

43. A printer apparatus for applying print to plastic film used in forming poly bags, said plastic film being supplied from a supply roll from which said plastic film is fed to said printer whereupon said plastic film is imprinted, said printer apparatus comprising:

a printer frame;

means for feeding said plastic film to an entrance of said printer frame;

a printer carriage movably carried by said print frame for reciprocating movement in a generally vertical direction, said print carriage having a first position in which said print carriage is moved to a retracted position, and said print carriage having a second position in which said print head is moved to a printing position for transferring print onto said plastic film during the print cycle;

a thermal print head carried by said carriage for applying print to a prescribed area of said plastic film during said print cycle;

an actuator for moving said printer carriage between said first and second positions;

a driven platen roller disposed adjacent said print head when said print carriage is moved to said second position, said plastic film being frictionally held between said platen roller and said print head when said printer carriage is moved to said second position;

a roller nip disposed downstream of said driven platen roller through which said plastic film is positive advanced in a printing relation to said print head together with said driven platen roller, said roller nip including at least one driven film roller;

a supply of inked ribbon for transferring print onto said plastic film;

a ribbon advance for positively advancing said ribbon across said printer carriage in operation print transfer.

44. The apparatus of claim 43 wherein said driven platen roller has an elastomeric outer covering.

45. The apparatus of claim 44 wherein said platen roller is resiliently biased toward said print head when said carriage is in said second position.

46. The apparatus of claim 45 wherein said outer elastomeric covering of said platen roller has a durometer of about 45 durometer.

47. The apparatus of claim 43 wherein said driven film roller disposed downstream of said driven platen roller has a friction surface, wherein said ribbon advance includes a driven ribbon roller, and said driven film roller and said driven ribbon roller define said nip to positively advance said plastic film and ribbon in a printing relation.

48. The apparatus of claim 47 including a second driven ribbon take up roll carried by said printer frame for taking up said ribbon after passing across said print head.

49. The apparatus of claim 48 including a ribbon roller disposed below said driven ribbon roller defining a nip therebetween which said ribbon is passed in a generally serpentine configuration.

50. The apparatus of claim 43 including a carriage position sensor for sensing when said printer carriage is moved to said second position for generating a ready print signal.

* * * * *